United States Patent [19]

Verhoog, Jr.

[11] Patent Number: 4,718,704

[45] Date of Patent: Jan. 12, 1988

[54] LATCH ASSEMBLY FOR A DOOR OR WINDOW

[75] Inventor: Cornelis Verhoog, Jr., Oostzaan, Netherlands

[73] Assignee: Verhoog's Handelsonderneming B.V., Zaandam, Netherlands

[21] Appl. No.: 933,322

[22] Filed: Nov. 20, 1986

Related U.S. Application Data

[63] Continuation of Ser. No. 562,732, Dec. 19, 1983, abandoned.

[30] Foreign Application Priority Data

Dec. 21, 1982 [NL] Netherlands ..... 8204919

[51] Int. Cl.[4] ..... E05C 1/14

[52] U.S. Cl. ..... 292/169; 292/336.3; 292/337; 292/DIG. 30; 292/DIG. 63

[58] Field of Search ..... 292/37, 169, 140, 187, 292/337, 346, DIG. 30, DIG. 52, DIG. 63, 92, DIG. 31, 347, 336.3, 170; 70/208, 209, DIG. 67

[56] References Cited

U.S. PATENT DOCUMENTS

| | | | |
|---|---|---|---|
| 244,405 | 7/1881 | Strong | 292/140 |
| 261,998 | 8/1882 | Carson | 292/140 |
| 317,051 | 5/1885 | Walsh | 292/37 |
| 1,427,253 | 8/1922 | Appleby | 292/37 X |
| 1,448,298 | 3/1923 | Hight | 292/37 X |
| 1,840,252 | 1/1932 | Reinhart | 292/169 X |
| 2,016,196 | 10/1935 | Handfield | 292/169 X |
| 2,088,665 | 8/1937 | Pinson | 292/37 |
| 2,796,628 | 6/1957 | Van Meter | 292/37 X |

*Primary Examiner*—Lloyd A. Gall
*Attorney, Agent, or Firm*—Daniel C. McKown

[57] ABSTRACT

A latching assembly particularly well suited for being mounted on the outside of an insulated door without having to disturb or reduce the insulating material, and which is concealed from view by a channel-like handle used for opening the door. The latching assembly includes a helical cam that rotates as the handle pivots and further includes a follower that is driven by the helical cam parallel to the axis of rotation. The latch bolt is attached to this follower, whereby pivoting motion of the handle is converted into translational motion of the latch bolt.

2 Claims, 2 Drawing Figures

LATCH ASSEMBLY FOR A DOOR OR WINDOW

BACKGROUND OF THE INVENTION

Related Applications

This applications is a continuation of application Ser. No. 562,732, filed Dec. 19, 1983 now abandoned.

The parent application is the U.S. counterpart of Netherlands patent application Ser. No. 8,204,919 of the same title filed Dec. 21, 1982 and assigned to Verhoog's Handelsonderneming B.V. of Zaandam. The benefit of the filing date of this Netherlands application is claimed for the present application under the International Convention.

FIELD OF THE INVENTION

The present invention is in the field of hardware fittings and more particularly relates to a manually-operated latch assembly for securing a door or window in a particular position.

The Prior Art

For latching doors and windows in the closed position, different lock and latch assemblies are known, comprising one or more lock or latch bolts longitudinally slidable under spring tension or not, as well as an actuating handle serving for retracting said bolts. If the door or window is to be latched in more than one point, and in particular at opposite sides, e.g. for insuring a gapless closure, the bolts or their actuating means should be mutually coupled. An example thereof is the espagnolette latch with two aligned latch bars which can be moved by the actuating handle in opposite senses.

Espagnolette fastenings have disadvantages, in particular in the case of spring-loaded latch bolts which are to be retracted only when opening the door or window, and are pushed back by a bevelled extremity thereof when closing. Such fastenings are now being used more and more in cupboard doors which sould closely fit in an outer frame, e.g. in fire-resistant cupboards for counteracting the penetration of combustion gases and warping of the door, in cooling or freezing cabinets for counteracting heat leakage, and the like. In insulating doors the provision of internal espagnolettes can be objectionable. Furthermore, easily actuable door handles are desirable, in particular in the form of open channels which can be gripped in arbitrary points, and serve, at the same time, for pulling open the door, but then a simple coupling with an espagnolette fastening is difficult. Although there exist fastenings of this kind with pulling cables for retracting the latch bolts, this requires a careful adjustment of the actuating means in order to ensure a sufficient retraction of the individual latch bolts under all circumstances, and, moreover, these elements are to be arranged in recesses in the door which can be objectionable in the case of insulated doors.

SUMMARY OF THE INVENTION

It is an object of the invention to provide an assembly for such purposes allowing a simple coupling between a latch bolt and an actuating handle, and, at the same time, an unambiguous actuation of such latch bolts, which assembly, in particular, can be mounted in a simple manner, and which, besides for the specific purposes mentioned above, can find a wide application in doors and windows of different kinds.

To that end the assembly according to the invention is characterised by a first cam element connected to an associated latch bolt and slidable together with said bolt in the longitudinal direction thereof, by a second now slidable cam element, at least one of said cam elements having a wedge surface along which a part of the other element is slidable, and by a driving element coupled with the actuating handle, by means of which both cam elements can be rotated with respect to one another in such a manner that a translation of the first element is obtained which is sufficient for disengaging the latch bolt in question.

In this manner a relatively small displacement of the actuating handle can be transformed, depending on the inclination of the wedge surface, into a sufficient translation of the latch bolt in question, and, moreover, this oblique surface can contribute to resetting the handle when the latch bolt is spring loaded.

In particular both cam elements are formed by cylindrical lugs having bevelled end faces with the same inclination angle which substantially contact each other in the latching position of the associated latch bolt. Such lugs can be manufactured in a simple manner, and consist, in particular, of nylon or a similar plastic, said lugs having, moreover, sliding surfaces which will not be attacked by atmospheric conditions.

The wedge surface of one of these cam elements can be provided with a flattened portion which is adapted to effect, in at least one extreme position, a fixation of the associated latch bolt in its retracted position.

If at least two latch bolts situated at opposite sides of a door or window are to be actuated, the actuating handle can be connected with means for simultaneously rotating the cam elements associated with the various latch bolts.

In a preferred embodiment of the invention, the actuating handle is formed by a handle bar rotatably supported at its extremities near the respective sides of the door or window around the axis of rotation of the respective cam elements, and connected, there, to the respective now slidable cam element.

In particular the latch bolts and cam elements can be mounted on the outer surface of the door or window, and be covered by the handle bar constructed as a continuous channel.

It is also possible to couple the actuating handle with a rotatable rod which is coupled to the rotatable cam elements associated with the respective latch bolts.

BRIEF DESCRIPTION OF THE DRAWINGS

The invention will now be elucidated below in more detail by reference to a drawing, showing in.

DETAILED DESCRIPTION OF THE PREFERRED EMBODIMENT

Figure 1:
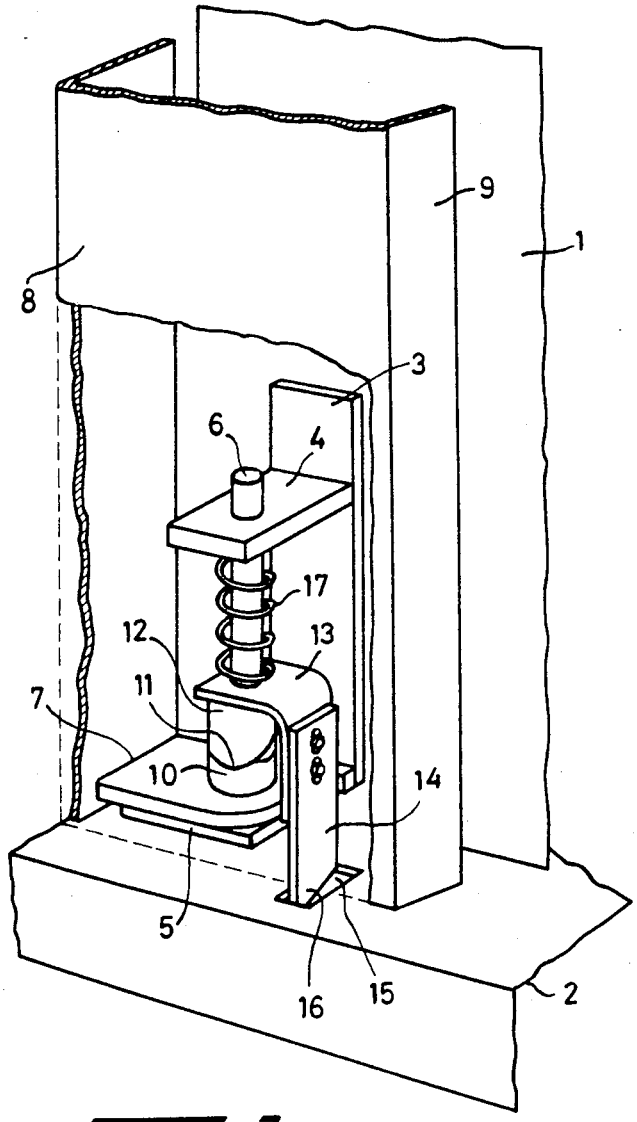
FIG. 1 a partial perspective view with parts broken away of a preferred embodiment of the assembly of the invention.

In FIG. 1 a preferred embodiment of a latch assembly according to the invention is shown which is adapted to be mounted on a door 1, in particular an insulating door, without having to provide recesses for accommodating the latch elements. Only a part of this door near the lower corner and a part of an associated sill 2 are shown. The corresponding upper portion is completely symmetrically constructed, so that it is not required to show and describe it.

Figure 2:
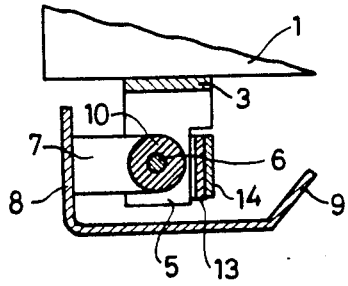
FIG. 2 a section of this assembly.

On the front wall of the door 1 a mounting part 3 with two bearing brackets 4 and 5 is fixed, which brackets support a vertical pin 6. This pin 6 serves as a pivot pin for a mounting support 7 fixed on a handle channel 8 having an obliquely off-set lateral rim 9 serving to be gripped when opening the door, as may best be seen in FIG. 2.

On the support 7 a cylindrical lug 10, e.g. of nylon or other suitable plastic, is non-rotatably fixed, said lug having an inclined terminal face 11, and, moreover, being provided with a central opening for passage of the pin 6. The support 7 rests, furthermore, on the bearing bracket 5 of the part 3. On the pin 6 a similar lug 12 with a corresponding bevel 11 is provided, which inclined end faces, as shown, rest on each other. The lug 12 is non-rotatably connected to an angle bracket 13 on which a latch 14 is mounted, which, in the closed position of the door 1, projects into a hole 15 of the sill 2, the bevelled extremity 16 of the latch 14 ensuring that, when closing the door 1, the latch is pushed away, a spring 17 between the bearing bracket 4 and the bracket 13 driving the latch 14 downwards. This latch 14 is retained against rotation by the lateral edge of the support 5.

If the edge 9 of the channel 8 is pulled, the latter rotates on the axis defined by the pin 6 and a similar pin at the upper end of the door 1, and the lug 10 will also rotate. The lug 12 will then be lifted by the mutual rotation of the bevels 11 of the lugs 10 and 12, so that the latch 14 is pulled out of the hole 15. The same occurs at the upper end of the door, so that the latter can be opened. When releasing the channel 8, the lugs 12 press, under the action of the associated springs 17, on the respective lugs 10, so that the channel 8 is rotated backwards, and the latches are driven outwards again. If required, additional springs can be provided which tend to rotate the channel 8 backwards.

In this manner a simple latch assembly is obtained which can be mounted directly on the door, the channel 8 covering the latches and associated parts. When the door is an insulating door, the insulation should not be removed anywhere for providing space for the latch elements. Moreover the channel 8 can be gripped at any point, which increases the ease of manipulation, in particular, independently of the height of the person in question.

For the rest it will be clear that such latch assemblies can also be recessed in the door if this is not objectionable, the channel 8 then exclusively serving as a handle bar.

Furthermore actuating elements shaped in a different manner can be used, if, for instance, the shaft 6 is fixed non-rotatably to one of the lugs 10 or 12, and the actuating element is adapted to rotate this shaft. In particular, the shaft 6 can be constructed so as to extend over the full height of the door 1, on which shaft lugs 10 or 12 are fixed at suitable points. When the lugs 12 connected to the latches 14 are rotated by the shaft 6, these lugs 12 should be slidable along the shaft 6. To that end the shaft can, for instance, have a non-circular (e.g., square or rectangular) cross-section, the lugs 12 then being provided with a hole with an adapted profile. When the lugs 10 are to rotate together with the shaft 6, these lugs must be non-slidably retained. In the case shown supporting by the support 7 is already sufficient to that end.

Besides the embodiment of the latches 14 shown, latches formed in a different manner can also be used. For instance, if the shaft 6 is fixedly connected to the slidable lug 12, this shaft itself can be used as the latch bolt, and one end thereof should, then, project beyond the door.

Furthermore latch hooks provided on the end face of the door and adapted to be engaged with cams or pins of the adjacent frame or on an end face of an adjacent door panel, can be actuated in the described manner, in particular by means of a continuous shaft 6 which can be rotated by means of a suitable handle.

If it is desired to retain such latches 14 in the retracted position, it is sufficient to provide one of the inclined surfaces 11 with a horizontal or slightly oppositely inclined recess on which the outer edge part of the other lug will come to rest so that, then, a backward rotation under the influence of the spring 17 is prevented until, by an opposite rotation of the handle, the inclined surfaces will contact each other again.

Instead of the lugs 10 and 12 shown, cam elements formed in a different manner can be used of course, provided that they are adapted to bring about, on rotation of one element in respect of the other, a longitudinal displacement of a latch or lock bolt. An operation corresponding to that of the inclined surfaces 11 of the lugs 10 and 12 will be obtained if the shaft 6 is replaced by a screw spindle (e.g., with a large pitch), and the lug 12 by a nut.

Furthermore the shaft 6 can be coupled, by means of conical gears or the like, with a horizontal shaft, e.g. if an operating element with a horizontal axle is to be used, or a coupling with latches or the like which are situated at a distance is to be effected.

Such a latching can, for instance, also be used in emergency doors in which, for instance, the channel 8 is formed in such a manner that, then, the latches will be disengaged when pressing it towards the door. Instead thereof it is also possible to use a horizontally directed pressing bar of current design which is coupled in a suitable manner to the shaft 6.

It will be clear that within the scope of the invention many modifications are possible.

What is claimed is:

1. A latch assembly that mounts entirely on the exterior of a door and yet is concealed from view and protected by a handle used to open the door, said latch assembly comprising in combination:

a door;

an actuating handle including an extended channel of generally concave cross section having two lips joined by a central portion;

means located on the exterior of said door for mounting said actuating handle to said door for limited pivotal motion about an axis that is parallel to the channel and parallel to said door with the lips of the channel extending toward but spaced from said door;

first cam means affixed to said actuating handle for pivotal motion with it and having an inclined cam surface that faces generally in a first axial direction and that progresses both axially and circumferentially around the axis;

second cam means slidably and non-rotatably mounted to the exterior of said door and having an inclined cam surface bearing against the inclined cam surface of said first cam means for producing a translational motion of said second cam means parallel to the axis when said actuating handle is pivoted;

a latch bolt connected to said second cam means for translational motion with said second cam means parallel to the axis, whereby rotation, in one sense, of said actuating handle about the axis results in translational motion of said latch bolt in one direction and rotation of said actuating handle in the opposite sense results in translational motion of said latch bolt in the opposite direction;

the two lips and the central portion of the extended channel substantially enclosing a space between the extended channel and said door;

said first cam means, said second cam means, and said latch bolt located in said space so as to be concealed from view and protected by said extended channel.

2. The latch assembly of claim 1 wherein said first cam means further comprise an uninclined cam surface, merging with the inclined cam surface and facing in the first axial direction and that progresses only circumferentially around the axis, and on which said second cam means rides as said actuating handle approaches one extreme of its limited pivotal motion to maintain said latch bolt at a corresponding extreme of its translational motion.

* * * * *